US006126097A

United States Patent [19]

Chen et al.

[11] Patent Number: 6,126,097

[45] Date of Patent: Oct. 3, 2000

[54] HIGH-ENERGY PLANETARY BALL MILLING APPARATUS AND METHOD FOR THE PREPARATION OF NANOMETER-SIZED POWDERS

[75] Inventors: Shizhu Chen, Changsha, China; Junsheng Yang; Bor Z. Jang, both of Auburn, Ala.

[73] Assignee: Nanotek Instruments, Inc., Opelika, Ala.

[21] Appl. No.: 09/379,146

[22] Filed: Aug. 21, 1999

[51] Int. Cl.[7] ..... B02C 17/08; B02C 17/24

[52] U.S. Cl. ..... 241/27; 241/29; 241/170; 241/175; 241/176

[58] Field of Search ..... 241/22, 27, 29, 241/170, 171, 172, 175, 176, 177, 184

[56] References Cited

U.S. PATENT DOCUMENTS

| | | | |
|---|---|---|---|
| 459,662 | 9/1891 | Pendleton . | |
| 569,828 | 10/1896 | Herzfeld . | |
| 1,144,272 | 6/1915 | West . | |
| 1,951,823 | 4/1934 | Eppers . | |
| 2,209,344 | 7/1940 | Mathews . | |
| 2,315,229 | 3/1943 | Schieferstein | 241/175 |
| 2,387,095 | 10/1945 | Shideler et al. . | |
| 2,874,911 | 2/1959 | Limb . | |
| 2,937,814 | 5/1960 | Joisel . | |
| 3,190,568 | 6/1965 | Freedman . | |
| 3,268,177 | 8/1966 | McKibben | 241/175 |
| 3,286,939 | 11/1966 | Karpenko et al. | 241/175 |
| 3,464,674 | 9/1969 | Pick | 241/175 X |
| 3,513,604 | 5/1970 | Matsunaga et al. . | |
| 3,529,780 | 9/1970 | Wilkinson . | |
| 3,876,160 | 4/1975 | Bloch . | |
| 3,981,488 | 9/1976 | Ratowsky . | |
| 4,042,181 | 8/1977 | Huber et al. | 241/175 |
| 4,057,191 | 11/1977 | Ohno . | |
| 4,125,335 | 11/1978 | Blume et al. | 241/175 X |
| 4,601,431 | 7/1986 | Watanabe et al. . | |
| 4,676,439 | 6/1987 | Saito et al. . | |
| 4,679,736 | 7/1987 | Orlando . | |
| 4,679,737 | 7/1987 | Romer . | |

(List continued on next page.)

OTHER PUBLICATIONS

A.N. Goldstein, "Handbook of Nanophase Materials," Marcel Dekker, Inc., New York, 1997.

C.C. Koch, "The Synthesis and Structure of Nanocrystalline Materials Produced by Mechanical Attrition: A Review," Nano Structured Materials, Feb. (1993) pp. 109–129.

H.J. Fecht, Nano Structured Materials, 1 (1992) pp. 125–130.

*Primary Examiner*—John M. Husar

[57] ABSTRACT

In accordance with a preferred embodiment, a rolling-type planetary ball mill apparatus for producing nanometer-scaled powders is disclosed, the apparatus comprising (a) a main rotary wheel comprising supporting members, (b) a plurality of mill pots which are revolvable by receiving a rotational force from the main rotary wheel through their corresponding supporting members, and are disposed around the main rotary wheel with substantially equal distance between one mill pot and another, each mill pot comprising a tiltable pivotal shaft having rotary coupling means so that the pot can also rotate about its own axis, each pivotal shaft having one end being supportably connected to its corresponding supporting member of the main rotary wheel; (c) motor means in drive relation to the main rotary wheel for providing rotational forces thereto; and (d) a non-revolvable counter-acting supporting ring disposed coaxially with the main rotary wheel and in the close, working vicinity of the mill pots; each tiltable pivotal shaft being capable of tilting toward the supporting ring permitting the pot to periodically contact with the ring, thereby inducing a planetary motion of the mill pot about its own axis. This apparatus provides much improved crushing forces and frequencies with which the grinding balls impact the powder materials inside the mill pots.

18 Claims, 7 Drawing Sheets

U.S. PATENT DOCUMENTS

| | | | |
|---|---|---|---|
| 4,720,050 | 1/1988 | Eberhardt . | |
| 4,733,825 | 3/1988 | Boyes et al. | 241/19 |
| 4,779,809 | 10/1988 | Miwa | 241/69 |
| 4,844,355 | 7/1989 | Kemp, Jr. . | |
| 4,887,773 | 12/1989 | Mehltretter . | |
| 5,029,760 | 7/1991 | Gamblin . | |
| 5,205,499 | 4/1993 | Gamblin . | |
| 5,232,169 | 8/1993 | Kaneko et al. . | |
| 5,314,125 | 5/1994 | Ohno | 241/175 |
| 5,356,084 | 10/1994 | Gamblin . | |
| 5,375,783 | 12/1994 | Gamblin . | |
| 5,383,615 | 1/1995 | Calka et al. . | |
| 5,522,588 | 6/1996 | Kaneko . | |
| 5,979,805 | 11/1999 | Angeletakis | 241/21 |

(a)

(b)

(c)

(d)

HIGH-ENERGY PLANETARY BALL MILLING APPARATUS AND METHOD FOR THE PREPARATION OF NANOMETER-SIZED POWDERS

FIELD OF THE INVENTION

The present invention relates to an apparatus and method for producing ultra fine powder particles, and more particularly, it relates to an improved high-energy ball milling apparatus and method for producing nanometer-sized particles at a high production rate.

BACKGROUND

Nano-phase metals and ceramics derived from nanometer-scaled particles are known to exhibit unique physical and mechanical properties. The novel properties of nano-crystalline materials are the result of their small residual pore sizes (small intrinsic defect sizes), limited grain sizes, phase or domain dimensions, and large fraction of atoms residing in interfaces. In a multi-phase material, limited phase dimensions could imply a limited crack propagation path if the brittle phase is surrounded by ductile phases so the cracks in a brittle phase would not easily reach a critical crack size. In addition, dislocation movement distances in a metal could be limited in ultra fine metallic domains. Even with only one constituent phase, nano-crystalline materials may be considered as two-phase materials, composed of distinct interfaces and crystalline phases. The possibilities for reacting, coating, and mixing various types of nano materials create the potential for fabricating new composites with nanometer-sized phases and novel properties.

The interest in ultra-fine particles or clusters (d<100 nm) is due to the unique processing characteristics as well as performance properties exhibited by small particles of metals, semiconductors and ceramics. Ultra-fine particles with a narrow size distribution have enormous potential in ceramic processing. For example, a green density of 75% has been achieved by compaction of nano-crystalline titania prepared by inert gas condensation of metal vapors.

Mono-dispersed particles are known to form a more uniform green micro-structure, which allows for a better control of the micro-structure during densification. In addition, smaller particles can be sintered at much lower temperatures. Not only the structure, but also the mechanical, electronic, optical, magnetic and thermal properties of nano-crystalline materials are different from those exhibited by their bulk counterparts. Specifically, ceramics fabricated from ultra-fine particles are known to possess high strength and toughness because of the ultra-small intrinsic defect sizes and the ability for grain boundaries to undergo a large plastic deformation. Additionally, ultra-fine grained metals could exhibit unusually high strength and hardness.

For a review on nano-phase materials please refer to A. N. Goldstein, "Handbook of Nanophase Materials," Marcel Dekker, Inc., New York, 1997. The techniques for the generation of nanometer-sized particles may be divided into three broad categories: vacuum, gas-phase, and condensed-phase synthesis. Vacuum synthesis techniques include sputtering, laser ablation, and liquid-metal ion sources. Gas-phase synthesis includes inert gas condensation, oven sources (for direct evaporation into a gas to produce an aerosol or smoke of clusters), laser-induced vaporization, laser pyrolysis, and flame hydrolysis. Condensed-phase synthesis includes reduction of metal ions in an acidic aqueous solution, liquid phase precipitation of semiconductor clusters, and decomposition-precipitation of ionic materials for ceramic clusters. Other methods include mix-alloy processing, chemical vapor deposition (CVD), and sol-gel techniques.

All of these techniques have one or more of the following problems or shortcomings:

(1) Most of these prior-art techniques suffer from a severe drawback: extremely low production rates. It is not unusual to find a production rate of several grams a day in a laboratory scale device. Vacuum sputtering, for instance, only produces small amounts of particles at a time. Laser ablation and laser-assisted chemical vapor deposition techniques are also well-known to be excessively slow processes. These low production rates, resulting in high product costs, have severely limited the utility value of nano-phase materials. There is, therefore, a clear need for a faster, more cost-effective method for preparing nanometer-sized powder materials.

(2) Condensed-phase synthesis such as direct reaction of metallic silicon with nitrogen to produce silicon nitride powder requires pre-production of metallic silicon of high purity in finely powdered form. This reaction tends to produce a silicon nitride powder product which is constituted of a broad particle size distribution. Furthermore, this particular reaction does not yield a product powder finer than 100 nm (nanometers) except with great difficulty. Due to the limited availability of pure metallic silicon in finely powdered form, the use of an impure metallic powder necessarily leads to an impure ceramic product. These shortcomings are true of essentially all metallic elements, not just silicon.

(3) Some processes require expensive precursor materials to ceramic powders and could result in harmful gas that has to be properly disposed of. For instance, the reaction scheme of $3SiCl_4+4NH_3=Si_3N_4+12HCl$ involves the utilization of expensive $SiCl_4$ and produces dangerous HCl gas.

(4) Most of the prior-art processes are capable of producing a particular type of metallic or ceramic powder at a time, but do not permit the preparation of a uniform mixture of two or more types of nano-scaled powders at a predetermined proportion.

(5) Most of the prior-art processes require heavy and/or expensive equipment (e.g., a high power laser source or a plasma generator), resulting in high production costs. In the precipitation of ultra fine particles from the vapor phase, when using thermal plasmas or laser beams as energy sources, the particle sizes and size distribution cannot be precisely controlled. Also, the reaction conditions usually lead to a broad particle size distribution as well as the appearance of individual particles having diameters that are multiples of the average particle size.

The method of ball milling has a great potential to become free from most of the above cited deficiencies. However, the conventional ball milling (mechanical attrition and grading) processes have the disadvantages that powders can only be produced up to a certain fineness (down to 0.5 $\mu$m) and with a relatively broad particle-size distribution. A laboratory-scale conventional ball mill is capable of producing only several kilograms of nano-scaled powders in approximately 100 hours. Fortunately, a scaled-up ball mill is known to have the capability to produce fine powders in "tonnage" quantity. If the power and efficiency of a ball mill can be significantly improved, ball milling can become a mass production method for the preparation of nano-scaled powders. In the past decade, it has been well demonstrated in research laboratories that the grinding effect of a high-energy planetary ball mill is sufficient for atomic scale combinations and chemical reactions between materials to be readily achieved. Amorphous phases, intermetallic compounds and solid solutions with a wide range of solubilities can be formed by ball milling. Pure elements, compounds and ceramics can be ground into manometer particles. For a review on this topic, please refer to: C. C. Koch, "The Synthesis and Structure of Nanocrystalline Materials Produced by Mechanical Attrition: A Review," NanoStructured Materials, 2 (1993) pp. 109–129.

Prior art grinding mills are disclosed in the following U.S. Pat. Nos. 459,662 (Sep. 1, 1891 to J. H. Pendleton); 569,828 (Oct. 20, 1896 to A. Herzfeld); 1,144,272 (Jun. 22, 1915 to A. L. West); 1,951,823 (Apr. 7, 1930 to W. P. Eppers); 2,209,344 (Jul. 30, 1940 to N. L. Mathews); 2,387,095 (Oct. 16, 1945 to E. M. Shideler and H. L. Bloxon); 2,874,911 (Feb. 24, 1959 to F. Limb); 2,937,814 (May 24, 1960 to A. Joisel); 3,190,568 (Jun. 22, 1965 to D. Freedman); 3,513,604 (May 26, 1970 to M. Matsunaga and H. Kobayashi); 3,529,780 (Sep. 22, 1970 to C. H. Wilkinson); 3,876,160 (Apr. 8, 1975 to R. Bloch); 3,981,488 (Sep. 21, 1976 to S. Ratowsky); 4,057,191 (Nov. 8, 1977 to I. Ohno); 4,601,431 (Jul. 22, 1986 to Y. Watanabe, et al.); 4,676,439 (Jun. 30, 1987 to K. Saito, et al.); 4,679,737 (Jul. 14, 1987 to T. R. Romer); 4,679,736 (Jul. 14, 1987 to J. Orlando); 4,720,050 (Jan. 19, 1988 to H. A. Eberhardt); 4,844,355 (Jul. 4, 1989 to P. B. Kemp, Jr.); 4,887,773 (Dec. 19, 1989 to J. C. Mehltretter). The drawbacks or shortcomings of these and other prior art grinding mills and related methods have been reviewed and summarized by R. L. Gamblin in U.S. Pat. Nos. 5,029,760 (Jul. 9, 1991), 5,205,499 (Apr. 27, 1993), 5,356,084 (Oct. 18, 1994) and 5,375,783 (Dec. 27, 1994). More recent work on high-energy grinding mills can be found in the following U.S. Patents and related foreign patents cited therein: U.S. Pat. Nos. 5,232,169 (Aug. 3, 1993 to K. Kaneko, et al.); 5,522,558 (Jun. 4, 1996 to K. Kaneko); and 5,386,615 (Jan. 24, 1995 to A. Calka and B. W. Ninham).

All these prior art grinding ball mills have one or more shortcomings in terms of power, efficiency, capacity, production rate, bulkiness, and/or equipment costs. Some of these grinding mills are not suitable for use in producing nanometer-scaled powder particles. Among the prior-art mills, the high-energy ball mills that involve planetary motions of mill pots appear to have the greatest potential for use in the preparation of nano-sized particles and novel alloys that would otherwise be difficult to fabricate. As discussed in a later section (DETAILED DESCRIPTION OF PREFERRED EMBODIMENTS), if the actions of impacting, squeezing and rubbing in a high-energy ball mill can be further improved, ball milling can become an ideal process for the mass production of nanometer-scaled powder materials.

Accordingly, one object of the present invention is to provide an improved ball milling apparatus and method for producing ultra fine powder materials.

Another object of the present invention is to provide an apparatus and method for producing ultra fine powder materials at a high production rate.

A specific object of the present invention is to provide an apparatus and method for producing nanometer-sized particles.

Still another object of the present invention is to provide a low-cost apparatus for producing a wide range of ultra fine powder materials at a high production rate.

A further object of the present invention is to provide an apparatus for producing a mixture of ultra fine powder materials which are well mixed and well dispersed at a predetermined proportion.

SUMMARY OF THE INVENTION

A preferred embodiment of the present invention is a planetary ball mill apparatus for producing nanometer-scaled powders. This ball mill is composed of three major components: a plurality of mill pots supported by a main shaft, a motor, and a non-revolvable counter-acting supporting ring. These mill pots are revolvable by receiving a rotational force from the main shaft through their corresponding supporting members and are disposed around the main shaft with substantially equal distance between one mill pot and another. Each mill pot contains a pivotal shaft having rotary coupling means so that the pot can also rotate about its own axis. Each pivotal shaft has one end being connected to its corresponding supporting member of the main shaft. The motor is disposed in the close, working proximity to the main shaft for providing rotational forces thereto. The stationary counter-acting supporting ring is disposed coaxially with the main shaft and in the close, working vicinity to the mill pots. Each pivotal shaft is equipped with a tiltable pivotal mechanism for tilting the pot toward the supporting ring, permitting the pot to periodically contact the ring and thereby inducing a planetary motion of the mill pot about its own axis.

In this configuration, the rotary coupling means may be just a ball bearing assemblage that enables the pivotal shaft of an individual mill pot to undergo a self-spin or rotation about its own axis. This ball bearing mechanism may also be made to provide the needed tilting mechanism that allows the mill pot to come in contact with the supporting ring under the influence of a centrifugal force produced during the primary rotational motion of the mill pots driven by the main shaft. Such a contact will force individual mill pots to self-spin in a direction opposite to the direction of this primary rotational motion. In another preferred embodiment, a separate tilting mechanism may be installed to enable tilting primarily along the radial direction of the main shaft.

Preferably, the supporting ring and the mill pots are provided with a switch device that turns on and off to force a mill pot to be in contact with and off the supporting ring in a predetermined sequence. This switch may work on the principle of alternately inducing magnetic attractive and repulsive forces between a ring-shaped magnet disposed on the mill pot and a magnetic field source disposed proximate the supporting ring.

The above-cited apparatus now makes it possible to carry out a new method for producing nanometer-scaled powders. This method, as another preferred embodiment of the present invention, comprises (a) providing micron- or millimeter-sized starting powders and selected numbers of grinding balls sealed in a plurality of mill pots which are driven by a main rotary wheel to undergo a primary rotational motion; (b) providing a stationary counter-acting supporting ring disposed coaxially with the main rotary wheel and in close working proximity to the mill pots; (c) providing each mill pot with rotary coupling means to permit a planetary rotation of each mill pot about its own axis, and a pivotal shaft being capable of tilting each mill pot toward the supporting ring permitting each mill pot to periodically contact with the ring, thereby inducing the planetary motion of the mill pot when undergoing the primary rotational motion; and (d) using a motor and proper transmission mechanisms (gear, bearing, belt, etc. as needed) to drive the primary rotational motion and the induced planetary motions for a predetermined period of time, stopping all the motions, and then removing the resulting fine powders from the mill pots.

Advantages of the present invention may be summarized as follows:

1. A wide variety of nano-scaled particles can be readily produced. The starting metal materials can be selected from any element in the periodic table that is considered to be metallic. The ceramic materials can be selected from the group of hydride, oxide, carbide, nitride, chloride, boride, silicide and sulfite and combinations thereof. No known prior-art technique is so versatile in terms of readily producing so many different types of nano-scaled ceramic, metallic and intermetallic compound powders.
2. The starting materials can be a mixture of alloys, pure elements, ceramics, and/or intermetallic compounds. When broken up into nano-sized clusters, these constituents will become uniformly dispersed and some of them are capable of reacting with reactant gas species intentionally added to induce predetermined chemical reactions.
3. The presently invented rolling-type high-energy planetary ball mill, as explained at a later section, exhibits much improved crushing forces and frequencies of the grinding balls. This feature makes the process fast and effective and now makes it possible to mass produce nano-sized ceramic powders cost-effectively.
4. The apparatus needed to carry out the invented process is simple and easy to operate. It does not require the utilization of expensive equipment. The over-all product costs are very low.

DETAILED DESCRIPTION OF PREFERRED EMBODIMENTS

In order to illustrate how the presently invented planetary ball mill differs from the conventional one, the working principle of a planetary motion is herein presented first. Specifically, the kinematics and kinetics of a high-energy planetary ball mill are analyzed as follows.

(A) Construction and Rotational Velocity of a High-Energy Planetary Ball Mill

Figure 1:
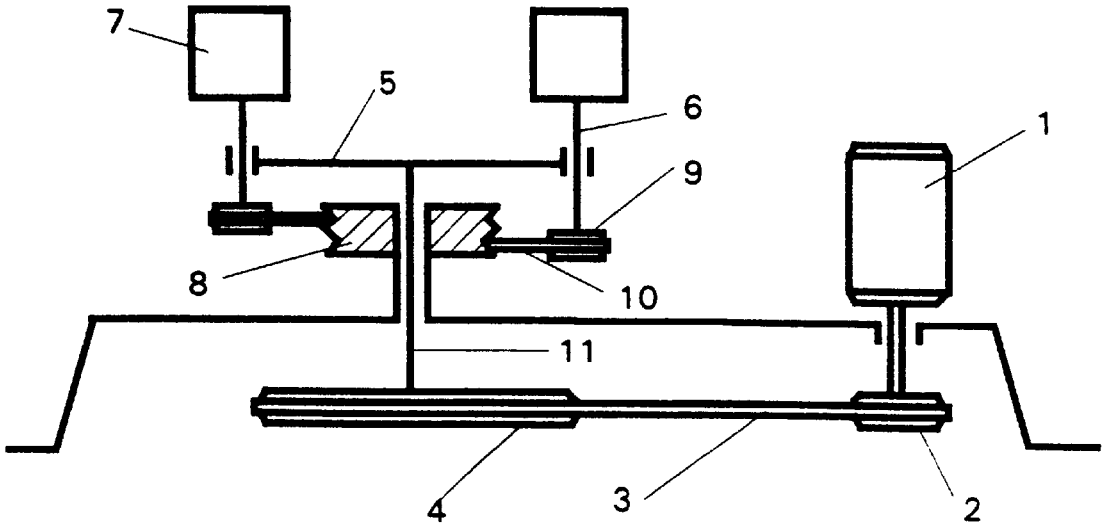
(Prior Art) FIG. 1
FIG. 1 Schematic of a conventional high-energy planetary ball mill.

FIG. 1 schematically shows a cross-section view of a conventional high-energy planetary ball mill. A small drive pulley (rotating wheel) 2 is connected to a motor 1 and receives rotational forces therefrom. These rotational forces are transmitted from a small pulley 2 to a large pulley 4 through a belt 3. Mill pots 7 (only two pots or cylinders are shown herein, with the support means being omitted) are held symmetrically on a rotary turntable 5. This rotary turntable, also referred to as the main shaft, is mounted on the same rotary shaft as the large pulley 4. The central rotary shaft 6 of each mill pot 7 forms a revolving pair with the turntable 5. The bottom end of the shaft 6 is connected to and supported by a planetary pulley 9. The pulley 9 corresponding to each mill pot is connected to a central pulley 8 through a gear or belt 10 based transmission system, forming a planetary motion pair. The central pulley 8 is disposed coaxially with the large drive pulley 4 and the turntable 5 on the same base. The two drive pulleys 4, 5 and the auxiliary central pulley 8 share a common central axis 11.

Figure 2:
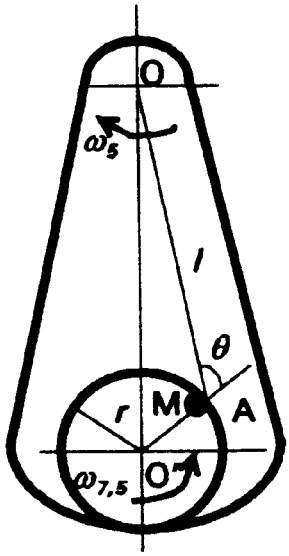
FIG. 2 A diagram for illustrating the various velocity and acceleration vectors of a ball inside a mill pot of a planetary ball mill.
Figure 2:
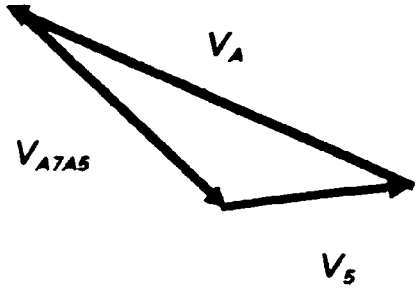
Figure 2:
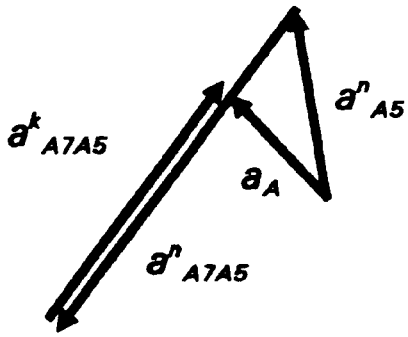
Figure 2:
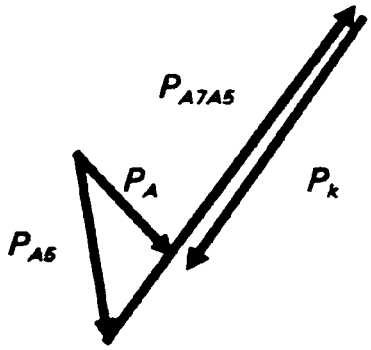

When starting the motor 1, the turntable 5 will rotate and all the mill pots will undergo a primary revolving motion about the central axis 11. At the same time, each mill pot 7, working congruently with the auxiliary pulley 8, will make a planetary motion. In this vertical style ball mill, the pivot axes of all rotary bodies are vertical to the floor. As compared to a conventional fixed shaft mill system, it is far more complex to calculate the motions of balls in a planetary ball mill. This is because each mill pot 7 not only revolves around the central shaft axis (hereinafter also referred to as the primary rotational motion) but also undergoes a spin about its own axis. For the planetary pulley system as shown in FIG. 2, the following relationship can be obtained by using a relative angular velocity method or a geometric analysis method:

$$\omega_7=(1-D_8/D_9)\omega_5 \tag{1}$$

where $\omega_7$, $\omega_5$ are the absolute angular velocities of the turntable 5 and mill pot 7, respectively and $D_8$, $D_9$ are the effective diameters of pulleys 8 and 9, respectively.

Equation (1) implies that not only the absolute angular velocity $\omega_7$ of the mill pot 7 but also its rotational direction are related to $D_8$ and $D_9$. This is one of the characteristics of a planetary ball mill. In a commonly used high-energy planetary ball mill, $D_9<D_8$, then $D_8/D_9>1$, so $(1-D_8/D_9)<0$, indicating $\omega_7$ and $\omega_5$ rotate in opposite directions. Also, the relative angular velocity between a mill pot 7 and the turntable 5 is $$\omega_{7,5}=\omega_5+\omega_7 \tag{2}$$

where $\omega_{7,5}$ is in the opposite direction with respect to $\omega_5$.

(B) Analysis of Kinematics and Kinetics of a High-Energy Ball Mill

The motions of grinding balls in a conventional horizontal ball mill featuring a fixed shaft rotation are well understood. In a conventional non-planetary ball mill, a ball first reaches a certain height due to the rotation of the mill pot. Then the ball is separated from the wall of a mill pot and drops down due to the gravity to crush the powdered materials. Clearly, on one hand, the mill pot has a critical rotational speed above which balls will not be separated from the wall due to the high centrifugal force. On the other hand, if the speed is too low, balls will not reach an enough height, resulting in an ineffective crushing force. These two features are not desirable for efficient grinding of powdered materials. In a high-energy planetary ball mill, the situation is quite different, nevertheless.

As shown in FIG. 2(*a*), O and O' are the rotary centers of the turntable 5 and the mill pot 7, respectively, and r is the inside diameter of the mill pot. Suppose one ball M with mass m is located at position A of the mill pot wall. The distance between A and O is 1, then $$V_A=V_{A5}+V_{A7A5} \tag{3}$$

where $V_A$ is the absolute velocity of ball M; $V_{A5}$ is the velocity of M induced by the turntable 5, being vertical to OA and having a value of $\omega_5 l$; and $V_{A7A5}$ is the relative velocity of M with reference to the turntable 5 in a direction perpendicular to O'A.

Suppose we ignore the transient effect that could occur when the speed is being adjusted, the turntable 5 will rotate with a uniform angular speed during the steady rotational motion state. The acceleration of ball M at point A is given by $$a_A=a^n_{A5}+a^n_{A7A5}+a^k_{A7A5} \tag{4}$$

where $a_A$ is the absolute acceleration of ball M; $a^n_{A5}$ is the normal component of the acceleration exerted by the turntable 5 on M at point A, this vector pointing from A to O with a value of $\omega^2_5 l$; $a^n_{A7A5}$ is the normal component of the acceleration of M at Point A with reference to the turntable 5, pointing from A to O' with a value of $\omega_{7,5}{}^2 r$; and $a^k_{A7A5}$ is the Kepler or planetary acceleration of M at point A, pointing along the extension line of O'A and having a value of $2\omega_5 V_{A7A5}$.

From Eq.(4), one can infer that the value and direction of $a_A$ are related to a plurality of factors; specifically, its direction is not as easily predicted as in the conventional ball mill and can only be obtained by solving the vector equation. Multiplying both sides of Eq.(4) by m, we have $$ma_A=ma^n_{A5}+ma^n_{A7A5}+ma^k_{A7A5} \tag{5}$$

where $ma_A$ is the total inertia $P_A$ on M and is in opposite direction to $a_A$; $ma^n_{A5}$is the vector of inertia $P_{A5}$ caused by the turntable-induced acceleration of M, which is opposite in direction to $a^n_{A5}$; $ma^n_{A7A5}$ is the vector of inertia $P_{A7A5}$ caused by the relative acceleration, in opposite direction to $a^k_{A7A5}$; and $ma^k_{A7A5}$ is the vector of inertia $P_k$ caused by the Kepler acceleration, which is in opposite direction to $a^k_{A7A5}$.

FIGS. 2(*b*), 2(*c*) and 2(*d*) respectively show the polygons of the velocity vector, acceleration vector and inertia vector of ball M at point A. It may be noted that these vectors are not drawn according to any actual values. Instead, the shape of the polygons and the directions of related absolute velocity $V_A$, absolute acceleration $a_A$, and total inertia are all based on reasonably assumed values for the purpose of illustrating the salient features of a planetary ball mill. With these diagrams, one can more easily understand the motion principle of the grinding balls in a high-energy planetary ball mill from the above vector analysis.

In order to let the balls crush and grind the powdered materials in the mill pots, balls should be separated from the mill pot wall at proper positions and made to crush towards a proper direction (e.g., toward another side wall). From FIG. 2(*a*) we can see that inertia $P_{A5}$ and $P_k$ are the forces which cause ball M to be separated from the mill pot wall and to crush towards another side. While inertia $P_{A7A5}$ is the resistance, the earth's gravity is not involved. Suppose θ is the angle between line OA and extension line O'A, then the condition at which a ball M is separated from the mill pot wall is given by:

$$P_{A5}\cos\theta+P_k \geqq P_{A7A5} \tag{6}$$

That is, $$\omega^2_5 l\cos\theta+2\omega_5\omega_{7,5}r \geqq \omega_{7,5}{}^2 r \tag{7}$$

Further, according to the definition of a relative angular velocity, $$\omega_{7,5}=\omega_5+\omega_7 \tag{8}$$

Hence, $$l\cos\theta \geqq [(1-D_8/D_9)^2-1]r \tag{9}$$

The left side of Eq.(9) shows the position of point A. It indicates that the condition for a ball to be separated from the mill pot wall at point A is related to the diameter $D_8$ of the auxiliary pulley 8, diameter $D_9$ of the planetary pulley 9, and radius r of the mill pot 7, but is independent of the rotational velocity of the turntable 5. The critical condition at which the separation process starts is $$l\cos\theta=[(1-D_8/D_9)^2-1]r \tag{10}$$

This equation shows that, once the dimensions of a high-energy planetary ball mill have been determined, the position of a ball at which it is separated from the mill pot wall will be fixed. This is the characteristic of a high-energy planetary ball mill. Therefore, the design of a high-energy planetary ball mill depends on the point of balls being separated from the mill pot wall, not on the velocity adjustments made during the operation of a mill. The purpose of making a velocity adjustment, on one hand, is to adjust the impact inertia of balls. Since the inertia is in direct proportion to the square of the rotational velocity, an increase in the rotational velocity will cause the impact force of the balls to increase dramatically, thereby crushing the powdered materials more strongly. On the other hand, the increase in rotational velocity will increase the frequency with which the balls impact and crush the powdered materials. In a high-energy planetary ball mill, for balls with the same mass, the impact force can be increased by more than tenfold as compared with a conventional ball mill.

The effect on the impact frequency is even more dramatic. The impact frequency is only 1–2 cycles/s in a conventional ball mill. In contrast, the frequency in a high-energy planetary ball mill can be increased relatively freely because the rotational velocity has no effect on the separation conditions of balls from the mill pot wall. The main factor that has an effect on the impact frequency is the bearing capacity of the rotary shaft of a mill pot. In a high-energy ball mill, the rotary shaft is just like a cantilever beam and it rotates with the same velocity as the mill pot. The flexural stress on the bottom of the rotary shaft is higher and changes periodically. Too high an impact frequency will increase the stress of the rotary shaft and could cause a fatigue failure. Therefore, the impact frequency in a conventional high-energy planetary ball mill has been limited, up to approximately 10–15 cycles/s. Both the impact force and impact frequency can be further improved by using the presently invented apparatus, explained as follows:

(C) Preferred Embodiments

Figure 3:
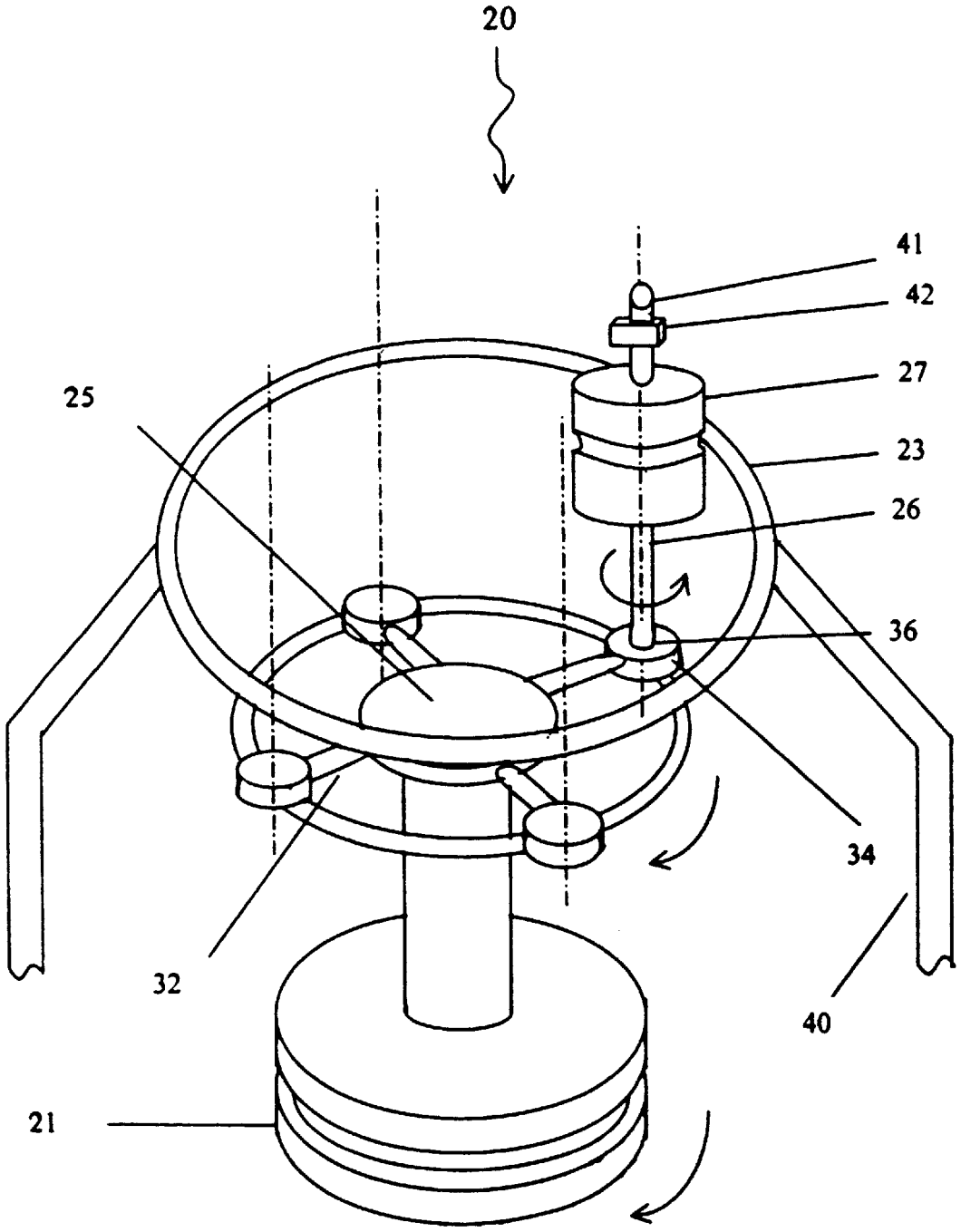
FIG. 3 Schematic of a preferred embodiment of an apparatus for producing nanometer-sized ceramic powders.

As a preferred embodiment of the present invention schematically shown in FIG. 3, a rolling-type planetary ball mill apparatus 20 is composed of three major components: (a) a plurality of mill pots (only one of the four pots, designated by the same numeral 27, is shown in FIG. 3) supported by (b) a main rotary wheel or turntable 25 (which is connected to a rotary base 21 driven by a motor), and (c) a non-revolvable counter-acting supporting ring 23 that is supported by a sturdy frame 40. These mill pots are revolvable as driven by a rotational force from the main rotary wheel 25 comprising supporting members 32 to hold the respective mill pots 27. The pots are disposed around the main rotary wheel with substantially equal distance between one mill pot and another. Each mill pot contains a tiltable pivotal shaft 26 having rotary coupling means 34 so that the pot can also rotate about its own axis. Each pivotal shaft 26 has a first end 36 being connected to its corresponding supporting member 32 of the main rotary wheel through coupling means 34. Preferably, each mill pot is equipped with a pipe 41 and a valve 42 through which an inert gas or reactant gas can be introduced into the pot when necessary.

A motor is disposed in the close, working proximity to the main rotary wheel or rotary base 21 for providing rotational forces to the wheel. The non-revolvable counter-acting supporting ring 23 is disposed coaxially with the main rotary wheel and in the close, working proximity to the mill pots. Each pivotal shaft is equipped with a tiltable pivotal mechanism for tilting the pot toward the supporting ring, permitting the pot to periodically contact with the ring and thereby inducing a planetary motion of the mill pot about its own axis. Tilting mechanisms are commonly found in prior art literature.

Figure 4:
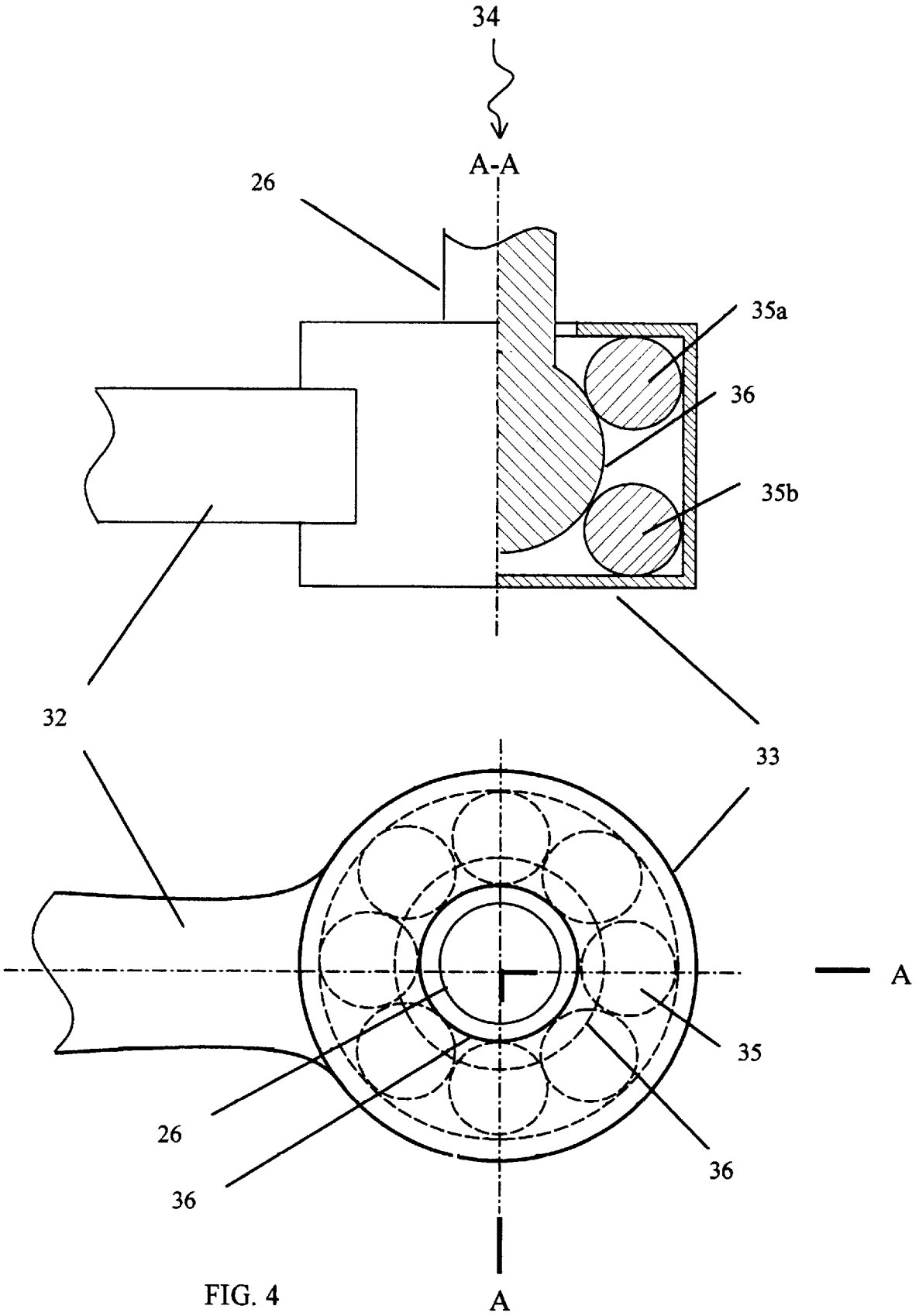
FIG. 4 A rotary coupling mechanism that permits the rotation of a mill pot about its own axis. The same mechanism also enables a mill pot to tilt toward the counteracting support ring.

In this configuration, the rotary coupling means 34 may be just a ball bearing assemblage (e.g., as shown in FIG. 4) that enables the pivotal shaft of an individual mill pot to undergo a self-spin or rotation about its own axis. In this example, the bottom end 36 of a shaft 26 is shaped like a larger ball which is constrained by two sets of smaller balls, 35*a* and 35*b*. These balls 35 provide three functions: (1) they allow the end ball 36 to rotate so that the shaft 26 can rotate about its own axis, (2) the upper set of balls 35*a,* in conjunction with the casing 33, prevent the shaft from escaping off the coupling mechanism 34, and (3) they are capable of providing the needed tilting mechanism that allows the mill pot to come in contact with the supporting ring under the influence of a centrifugal force produced during the primary rotational motion of the mill pots driven by the main rotary wheel. Such a contact will force individual mill pots to self-spin in a direction opposite to the direction of this primary rotational motion.

In the presently invented rolling-type high-energy planetary ball mill, the mill pot is supported by a tiltable shaft that is capable of freely tilting toward a supporting ring. When in contact with this supporting ring, a cylindrical mill pot that is driven to revolve along with the main rotary wheel (e.g., 25 in FIG. 3) will be made to undergo a planetary motion in a direction opposite to that of the main rotary wheel. This planetary motion is activated only when the tilting angle is such that the mill pot touches the supporting ring. The frequency of such contacts can be freely controlled. In one preferred embodiment, the shaft 26 may be allowed to tilt to a small extent toward any direction when the rotary wheel 25 remains stationary. When the wheel begins to revolve, the shaft 26 will be forced to tilt toward the supporting ring 23 due to the centrifugal force. Referring back to the prior-art planetary ball mill of FIG. 1 again, the shaft 6 is held by the rotary wheel 5 to revolve about axis 11. During such a revolving motion, the shaft 6 through the rotary connection at pulley 9 produces a planetary motion. Such a configuration produces large bending moment-induced stresses to the shaft 6, easily leading to fatigue failures of the shaft. By contrast, the configuration in our present invention (FIG. 3) involves a simply-supported shaft 26. The stressing situation is significantly improved with fatigue failure being reduced or eliminated. Furthermore, the high linear speed at the point of contact induced by a large-diameter turntable 25 and the large turntable/pot diameter ratio make the mill pot spin at a much higher velocity as compared with the traditional planetary ball mill. These factors allow the impact frequency of the grinding balls to reach as high as 20–30 cycles/s.

Figure 5:
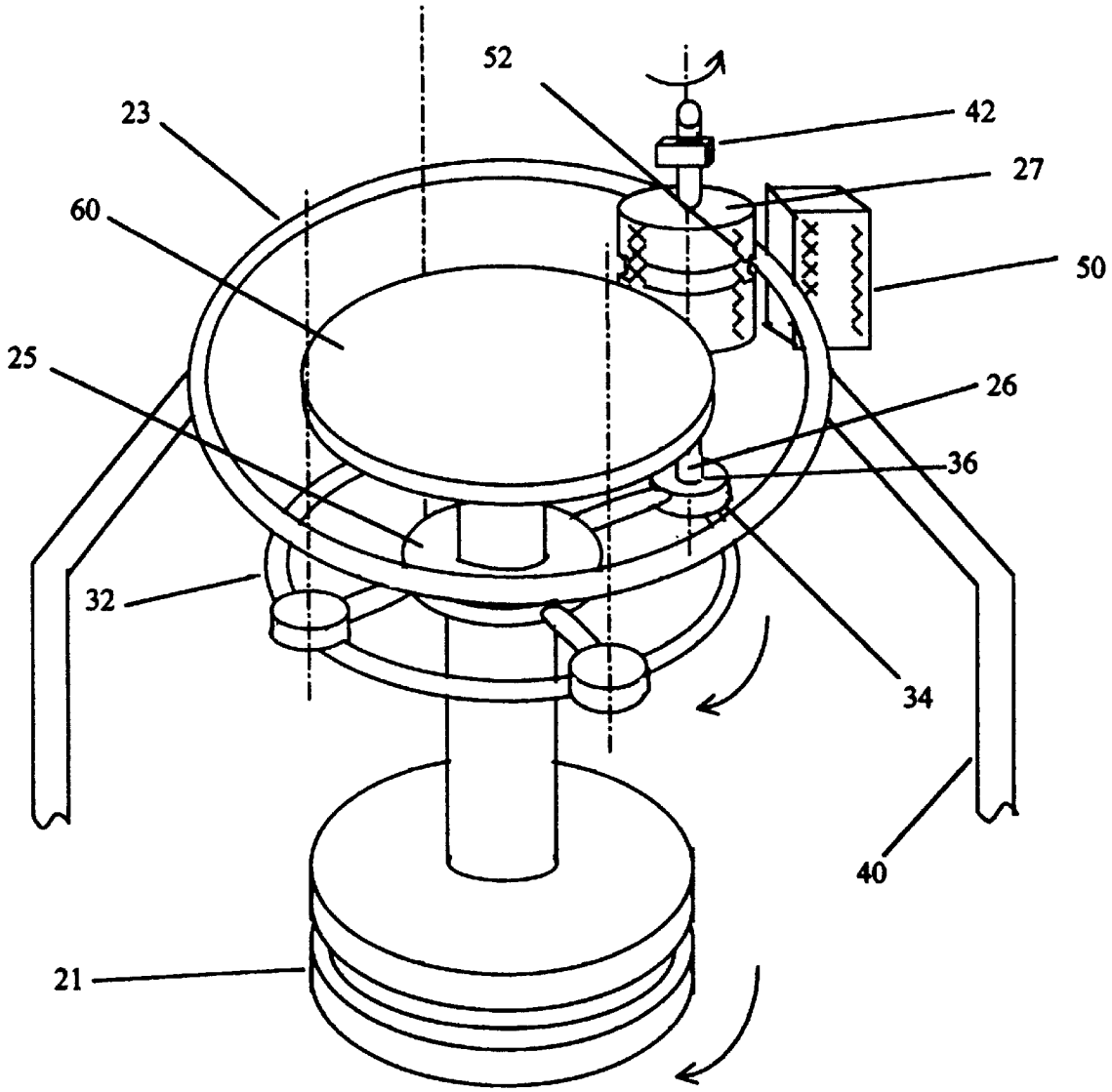
FIG. 5(A) A switch device for regulating the frequency of contacts between a mill pot and a counteracting ring.
FIG. 5(B) Another example of a rolling-type high energy planetary ball mill.
Figure 5:
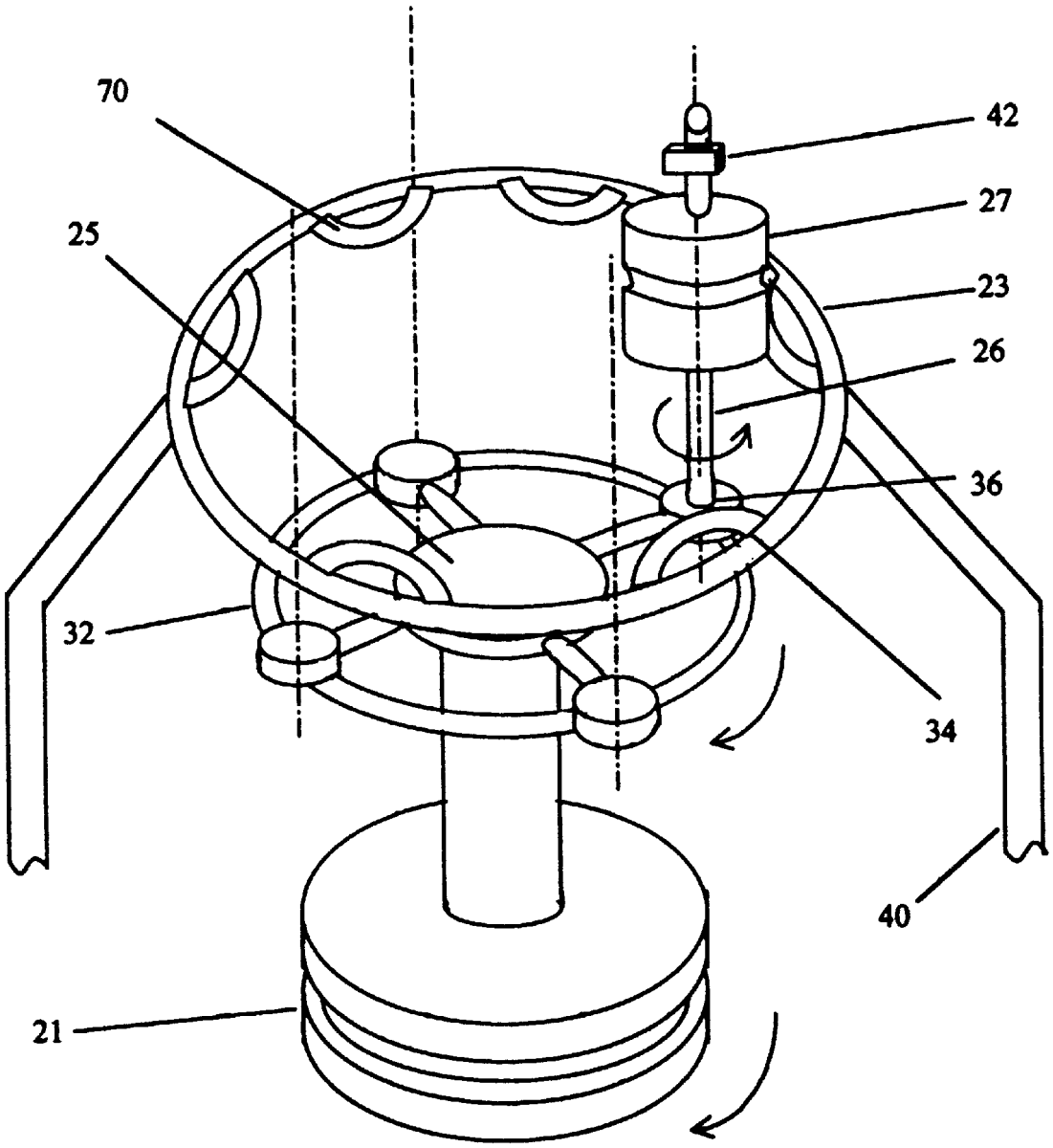

Another preferred embodiment of the present invention again comprises a rolling-type planetary ball mill, but further comprising a switch device to regulate the frequency of contacts between a mill pot 27 and the counteracting ring 23, as indicated in FIGS. 5 (*a*) and (*b*). A preferred switch device comprises a permanent magnet strip 52 attached to the surface of a mill pot and a matting magnet 50 for producing a magnetic field to repel or attract the permanent strip. This electrically induced magnetic force will periodically bring a mill pot in physical contact with the ring 23 or to separate the pot from the ring, depending upon the magnetic force field direction (N-to-S or N-to-N). When a pot 27 is in contact with the ring 23, the pot will undergo a planetary motion in a direction opposite to the primary rotating direction of the rotary wheel 25. An optional counteracting ring or wheel device 60 may be vertically attached to the top center part of the rotary wheel 25. When the rotary wheel 25 revolves this device 60 will rotate along with it. This arrangement makes it possible to exercise another way of regulating the planetary motion of a mill pot. For instance, the mill pot 27 in FIG. 5(*a*) may be pushed to contact the counteracting ring 60, on demand, by a strong repulsive force between the magnet strip 52 and the magnet 50. As indicated in FIG. 5(*c*), the surface profile of the supporting ring 23 does not necessarily have to be strictly circular; it could be elliptical. Further, small bumps (e.g., 70) on the ring 23 could bring about additional shaking forces to a mill pot if so desired. These examples serve to illustrate the flexibility in controlling the motions of mill pots in our new ball mill designs.

Furthermore, after the balls are separated from the wall of a mill pot they undergo additional rubbing motions near the bottom of the mill pot, in contrast to the simple free falling of balls in a conventional ball mill. The motion of balls is relatively complex near the bottom of a mill pot. Due to the motion of the bottom portion of a pot, the balls are made to undergo another type of Kepler or planetary motion, resulting in additional acceleration and, hence, additional inertia forces. Due to the coexistence of turntable-exerted inertia, relative inertia, additional inertia, additional relative inertia as well as the friction between balls and the bottom of a mill pot, the motion of balls is very complicated and their movement loci are difficult to precisely track down. However, this kind of complicated motion plus the motion of a ball relative to the bottom of a mill pot (rolling and sliding) can strongly squeeze, rub, and crush the powdered materials, so that the grinding capacity can be increased dramatically. The above kinematics and kinetics analysis is based on the case of one single ball. The motions of balls with different sizes and materials are expected to be even more complicated. The above discussion has demonstrated that the working ability of a high-energy ball mill can be dramatically improved through a proper design.

According to the above analysis, the balls in a high-energy planetary ball mill can crush the materials with at least a tenfold higher impact force and frequency than in a conventional ball mill. The grinding balls can strongly squeeze, rub and crush the powdered materials during their complicated motions in the mill pot. Therefore, the powdered materials in the mill pot can be ground into nano-scaled particles in a very short period of time. Due to the formation of nanosized powders, many physical and chemical properties of materials can be changed. The thermodynamics and kinetics of such a solid state reaction are quite different from the reactions that occur in bulk phases. Some solid reactions that are considered impossible to occur in larger-sized materials can be made to occur by the grinding and crushing actions in a high-energy ball mill. Additionally, rapid physical or chemical changes can occur after a short period of time of grinding and crushing actions at elevated temperatures and pressures, a process similar to the synthesis of artificial diamond. This is another important characteristics of mechanical alloying using a planetary ball mill.

A wide variety of nano-scaled powders of pure metals, metal alloys and intermetallic compounds have been prepared by mechanical alloying. Examples include the work conducted by H. J. Fecht (in NanoStructured Materials, Vol. 1, pp. 125–130, 1992) on body centered cubic elements (Fe, Cr, Nb, W), hexagonal close-packed elements (Zr, Hf, Co, Ru), and CsCl-type compound phases (CuEr, NiTi, AlRu and SiRu). A standard ball mill (SPEX 8000) was used to grind powder samples of approximately 50–100 $\mu$m in initial particle sizes. It took approximately 20 hours to grind AlRu powders to an average particle size below 10 nm and 50 hours to grind Ru powders to 15 nm. Under comparable conditions, it took less than 4 hours to grind both AlRu and Ru powders to 10 nm using a rolling-type high-energy planetary ball mill.

This analysis has demonstrated the following features of the presently invented apparatus: (1) The grinding balls in a rolling type high-energy planetary ball mill can strongly crush the powdered materials due to the great inertia forces created. The increase in inertia forces is proportional to the square of the rotational speed. (2) In a rolling-type high-energy planetary ball mill, the condition at which a ball is separated from the mill pot wall is related to the design dimensions, not to the rotational velocity. The impact force and frequency of the balls exerted on the powdered materials can be increased by increasing the rotational velocity. (3) The grinding balls will make complicated motion near the bottom of a mill pot after they are separated from the mill pot wall. (4) Due to the frequent and intense actions of impacting, squeezing and rubbing of the grinding balls to the powdered materials, the materials can be ground into nano-scaled particles in a short period of time. In many cases, mechanical alloying of multi-component materials can be readily achieved.

This rolling-type planetary ball milling apparatus now makes it possible to carry out a new method for producing nanometer-scaled powders. This method, as another preferred embodiment of the present invention, comprises (a) providing starting powders, preferably in the micron- or millimeter-size ranges, and selected numbers of grinding balls sealed in a plurality of mill pots which are driven by a main rotary wheel to undergo a primary rotational motion; (In some cases, inert gas may be introduced into the pots to prevent potential heat-induced oxidation reactions. In some other cases, selected reactant gas molecules may be sealed inside a mill part so that these molecules can participate in desired chemical reactions with other ingredients in the pot.)

(b) providing a stationary counter-acting supporting ring disposed coaxially with the main rotary wheel and in the close, working proximity to the mill pots;

(c) providing each mill pot with rotary coupling means (e.g., a ball bearing assemblage) to permit a planetary rotation of each mill pot about its own axis, and a pivotal shaft being capable of tilting each mill pot toward the supporting ring permitting each mill pot to periodically contact with the ring, thereby inducing the planetary motion of the mill pot when undergoing the primary rotational motion; and (d) using a motor and proper transmission mechanisms (gear, bearing, belt, etc.) to drive the primary rotational motion and the induced planetary motions for a predetermined period of time, stopping all the motions, and then removing the resulting fine powders from the mill pots.

Figure 6:
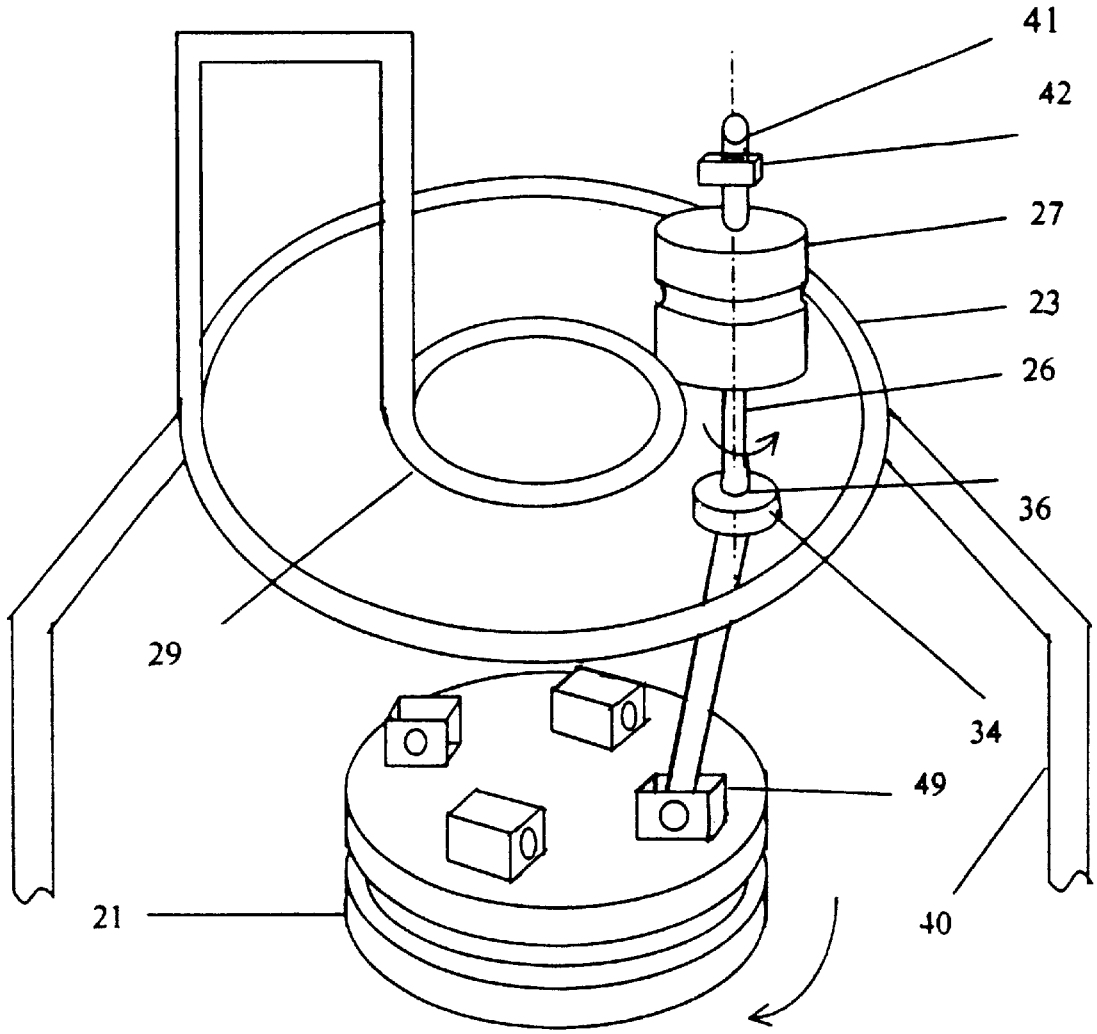
FIG. 6 Schematic of another preferred embodiment of a rolling-type high-energy planetary ball mill.

It may be noted that there are many possible variations to the presently invented ball mill apparatus. Those who are familiar with the art can make modifications to the presently stated preferred embodiments; however, such simple modifications should be construed as being embraced by the present invention. For instance, as indicated in FIG. 6, a mill pot may be directly connected to the rotary base 21 through a tilting mechanism 49 without using a separate rotary wheel 25. Only one of the four mill pots is shown in FIG. 6 so that the diagram would not look too crowded. In this case, the rotary wheel is the rotary base 21. A similar coupling mechanism 36 again makes it possible to the mill pot 27 to spin about its own axis. In the present configuration, the tilting mechanism 49 permits tilting along the radial direction only (but not tangentially). Under the influence of a centrifugal force, the mill pot will shift to get in contact with the supporting ring 23. Optionally, an additional counter-acting support ring 29, smaller in diameter, may be used to support the mill pots. Again, preferably, an electromagnetic switch mechanism may be used to reversibly tilt the mill pot toward the supporting ring 23 for producing the desired planetary motions when so desired.

What is claimed:

1. A planetary ball mill apparatus for producing nanometer-scaled powders, comprising:

(a) a main rotary wheel comprising supporting members;

(b) a plurality of mill pots which are revolvable by receiving a rotational force from said main rotary wheel, said pots being disposed around said main rotary wheel with substantially equal distance between one mill pot and another, each said mill pot comprising a tiltable pivotal shaft having rotary coupling means so that each said pot can also rotate about its own axis, and each said pivotal shaft having one end being supportably connected to one of said supporting members of the main rotary wheel;

(c) motor means in drive relation to said main rotary wheel for providing rotational forces thereto; and (d) a non-revolvable counter-acting supporting ring disposed coaxially with said main rotary wheel and in the close, working proximity to said mill pots with each said tiltable pivotal shaft being capable of tilting toward said supporting ring permitting each said mill pot to periodically contact therewith, thereby inducing a planetary motion of said mill pot about its own axis.

2. An apparatus as set forth in claim 1, wherein said rotary coupling means comprise ball bearing means.

3. An apparatus as set forth in claim 1, wherein at least one of said mill pots further comprises pipe and valve means through which desirable gases can be introduced into and sealed inside said at least one pot.

4. An apparatus as set forth in claim 1, further comprising switch means in control relation to each said mill pot for reversibly engaging said individual pots with said supporting ring to induce planetary motions on demand.

5. An apparatus as set forth in claim 4, wherein said switch means comprises a magnet.

6. An apparatus as defined in claim 1 wherein said supporting ring is substantially circular in shape.

7. An apparatus as defined in claim 1 wherein said supporting ring is substantially elliptical in shape.

8. An apparatus as defined in claim 1 wherein said supporting ring comprises small bumps to induce additional irregular motions of said mill pots.

9. An apparatus as defined in claim 1, further comprising an additional supporting ring disposed above said rotary wheel and coaxially connected thereto, said additional supporting ring being substantially circular in shape and smaller in diameter so that said mill pots revolve in a path no smaller than said diameter.

10. A method for producing nanometer-scaled powders, comprising:

(a) providing micron- or millimeter-sized starting powders and selected numbers of grinding balls sealed in a plurality of mill pots which are driven by a main rotary wheel to undergo a primary rotational motion;

(b) providing a non-revolvable counter-acting supporting ring disposed coaxially with said main rotary wheel and in the close, working proximity to said mill pots;

(c) providing each said mill pot with rotary coupling means to enable a planetary rotation of each said mill pot about its own axis, and a pivotal shaft being capable of tilting each said mill pot toward said supporting ring permitting each said mill pot to periodically contact therewith, thereby inducing said planetary motion of each said mill pot when undergoing said primary rotational motion; and (d) using motor means to drive said primary rotational motion and the induced planetary motions for a predetermined period of time, stopping all said motions, and removing resulting fine powders from said mill pots.

11. A method as defined in claim 10, wherein said rotary coupling means comprise ball bearing means.

12. A method as defined in claim 10, comprising an additional step of introducing a predetermined amount of desirable gases into at least one of said mill pots.

13. A method as defined in claim 10, further comprising a step of using switch means to periodically bring each said mill pot in physical contact with said supporting ring to induce said planetary motions.

14. A method as defined in claim 10, wherein said switch means make use of an electromagnetic switching mechanism.

15. A method as defined in claim 10 wherein said starting powders comprise an admixture of at least two different materials.

16. A method as defined in claim 10 wherein said starting powders comprise a material selected from a group of materials consisting of metallic elements, intermetallic compounds and ceramic materials.

17. A planetary ball mill apparatus for producing nanometer-scaled powders, comprising:

(a) a main rotary base comprising supporting members;

(b) a plurality of mill pots which are revolvable by receiving a rotational force from said rotary base, said pots being disposed around and above said rotary base with substantially equal distance between one mill pot and another, each said mill pot comprising a shaft, a tilting mechanism and rotary coupling means so that each said pot can rotate about its own axis, and each said shaft having one end being supportably connected to one of said supporting members of the rotary base;

(c) motor means in drive relation to said rotary base for providing rotational forces thereto; and (d) at least one non-revolvable counter-acting supporting ring disposed coaxially with said main rotary wheel and in the close, working proximity to said mill pots; each said tilting mechanism being capable of permitting its corresponding mill pot to periodically contact with said non-revolvable supporting ring, thereby inducing a planetary motion of said mill pot about its own axis.

18. An apparatus as defined in claim 17, further comprising a second counteracting ring disposed concentrically with and above said rotary base and wherein the revolving motions of said mil pots define a motion trajectory with said second ring being inside said trajectory.

* * * * *